US009032922B2

(12) United States Patent
Moon et al.

(10) Patent No.: US 9,032,922 B2
(45) Date of Patent: May 19, 2015

(54) CAMSHAFT ASSEMBLY

(71) Applicant: GM GLOBAL TECHNOLOGY OPERATIONS LLC, Detroit, MI (US)

(72) Inventors: Joseph J. Moon, Clawson, MI (US); Joel Cowgill, White Lake, MI (US); Hans-Guido Kemmer, Mainz (DE); Robert J. Moran, Ann Arbor, MI (US); Donn A. Frincke, Davison, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 0 days.

(21) Appl. No.: 14/058,639

(22) Filed: Oct. 21, 2013

(65) Prior Publication Data

US 2015/0107540 A1 Apr. 23, 2015

(51) Int. Cl.
*F01L 1/34* (2006.01)

(52) U.S. Cl.
CPC ..... *F01L 1/34* (2013.01)

(58) Field of Classification Search
CPC ..... F01L 1/34
USPC ..... 123/90.15, 90.16
See application file for complete search history.

(56) References Cited

U.S. PATENT DOCUMENTS

| | | | | |
|---|---|---|---|---|
| 5,159,905 | A * | 11/1992 | Sugiuchi et al. | 123/90.16 |
| 2007/0034184 | A1 * | 2/2007 | Dengler | 123/90.17 |
| 2011/0226205 | A1 | 9/2011 | Kraus | |
| 2012/0024245 | A1 * | 2/2012 | Nendel | 123/90.6 |

FOREIGN PATENT DOCUMENTS

| | | | |
|---|---|---|---|
| DE | 4230877 | A1 | 4/1993 |
| DE | 102007010151 | A1 | 4/2008 |
| DE | 102007010154 | A1 | 6/2008 |
| DE | 102007010155 | A1 | 9/2008 |
| DE | 102007061353 | A1 | 6/2009 |
| DE | 102009022657 | A1 | 1/2011 |
| DE | 102010022708 | A1 | 12/2011 |
| DE | 102010025099 | A1 | 12/2011 |
| DE | 102011115533 | A1 | 4/2013 |
| DE | 102011085707 | A1 | 5/2013 |
| WO | 2012110069 | A1 | 8/2012 |
| WO | 2013001069 | A1 | 1/2013 |

* cited by examiner

*Primary Examiner* — Zelalem Eshete
(74) *Attorney, Agent, or Firm* — Quinn Law Group, PLLC

(57) ABSTRACT

A camshaft assembly can control the motion of the intake or exhaust valves of an internal combustion engine and includes a base shaft extending along a longitudinal axis. The camshaft assembly further includes an axially movable structure mounted on the base shaft and axially movable relative to the base shaft. The axially movable structure includes a plurality of lobe packs. Each lobe pack includes a plurality of cam lobes. The axially movable structure includes a barrel cam defining a control groove. The camshaft assembly additionally includes an actuator including an actuator body and a pin movably coupled to the actuator body between a retracted position and an extended position. The axially movable structure can move axially relative to the base shaft when the base shaft rotates about the longitudinal axis and the pin is in the extended position and at least partially disposed in the control groove.

20 Claims, 12 Drawing Sheets

CAMSHAFT ASSEMBLY

TECHNICAL FIELD

The present disclosure relates to a camshaft assembly for an engine assembly.

BACKGROUND

Vehicles typically include an engine assembly for propulsion. The engine assembly may include an internal combustion engine defining one or more cylinders. In addition, the engine assembly may include intake valves for controlling inlet charge into the cylinders and exhaust valves for controlling the flow of exhaust gases out of the cylinders. The engine assembly may further include a valvetrain system for controlling the operation of the intake and exhaust valves. The valvetrain system includes a camshaft assembly for moving the intake and exhaust valves.

SUMMARY

The present disclosure relates to a camshaft assembly for controlling the motion of the intake and exhaust valves of an internal combustion engine. The camshaft assembly includes a base shaft extending along a longitudinal axis, lobe packs mounted on the base shaft, and a plurality of actuators for axially moving the lobe packs relative to the base shaft. The axial position of the lobe packs relative to the base shaft can be adjusted in order to change the valve lift profile of the intake and exhaust valves. As used herein, the term "valve lift" means the maximum distance that an intake or exhaust valve can travel from a closed position to an open position. In this disclosure, the term "valve lift profile" refers to the motion of an exhaust or intake valve with respect to the angular position of the base shaft.

It is useful to adjust the valve lift profile of the intake and exhaust valves depending on the engine operating conditions. To do so, the lobe packs that control the movement of the exhaust and intake valves can be moved axially relative to the base shaft. Actuators, such as solenoids, can be used to move the lobe packs axially relative to the base shaft. In order to minimize costs, it is useful to minimize the number of actuators used to displace the lobe packs of the camshaft assembly.

In an embodiment, the camshaft assembly includes a base shaft extending along a longitudinal axis. The base shaft is configured to rotate about the longitudinal axis. The camshaft assembly further includes an axially movable structure mounted on the base shaft. The axially movable structure can move axially relative to the base shaft. However, the axially movable structure is rotationally fixed to the base shaft. Therefore, the axially movable structure can rotate synchronously with the base shaft. The axially movable structure includes a plurality of lobe packs. Each of the lobe packs includes a plurality of cam lobes. The axially movable structure includes only one barrel cam. The barrel cam defines a control groove. The camshaft assembly additionally includes an actuator including an actuator body and at least one pin movably coupled to the actuator body. The pin can move relative to the actuator body between a retracted position and an extended position. The axially movable structure can move axially relative to the base shaft when the base shaft rotates about the longitudinal axis and the pin is in the extended position and at least partially disposed in the control groove.

The present disclosure also relates to engine assemblies. In an embodiment, the engine assembly includes an internal combustion engine including a first cylinder, a second cylinder, a first valve operatively coupled to the first cylinder, and a second valve operatively coupled to the second cylinder. The first valve is configured to control fluid flow in the first cylinder, and the second valve is configured to control fluid flow in the second cylinder. The engine assembly further includes a camshaft assembly operatively coupled to the first and second valves. The camshaft assembly includes a base shaft extending along a longitudinal axis. The base shaft can rotate about the longitudinal axis. The camshaft assembly further includes an axially movable structure mounted on the base shaft. The axially movable structure can move axially relative to the base shaft. However, the axially movable structure is rotationally fixed to the base shaft. The axially movable structure includes a plurality of lobe packs. Each lobe pack includes a plurality of cam lobes. The axially movable structure includes only one barrel cam. The barrel cam defines a control groove. The camshaft assembly further includes an actuator including an actuator body and at least one pin movably coupled to the actuator body. The pin can move relative to the actuator body between a retracted position and an extended position. The axially movable structure can move axially relative to the base shaft when the base shaft rotates about the longitudinal axis and the pin is in the extended position and at least partially disposed in the control groove in order to adjust a valve lift profile of the first and second valves.

In another embodiment, the engine assembly includes an internal combustion engine. The internal combustion engine includes a plurality of cylinders and a plurality of valves operatively coupled to the cylinders. The valves are configured to control fluid flow in the cylinders. The engine assembly further includes a camshaft assembly operatively coupled to the valves. The camshaft assembly includes a base shaft extending along a longitudinal axis. The base shaft can rotate about the longitudinal axis. The camshaft assembly further includes an axially movable structure mounted on the base shaft. The axially movable structure can move axially relative to the base shaft. Further, the axially movable structure is rotationally fixed to the base shaft. The axially movable structure includes a plurality of lobe packs. Each lobe pack includes a plurality of cam lobes. The axially movable structure includes a barrel cam. The barrel cam defines a control groove. The camshaft assembly further includes a single actuator for every two cylinders. The actuator includes an actuator body and at least one pin movably coupled to the actuator body. The pin can move relative to the actuator body between a retracted position and an extended position. The axially movable structure is configured to move axially relative to the base shaft when the base shaft rotates about the longitudinal axis and the pin is in the extended position and at least partially disposed in the control groove in order to adjust a valve lift profile of the valves.

The above features and advantages, and other features and advantages, of the present invention are readily apparent from the following detailed description of some of the best modes and other embodiments for carrying out the invention, as defined in the appended claims, when taken in connection with the accompanying drawings.

DETAILED DESCRIPTION

Figure 1:
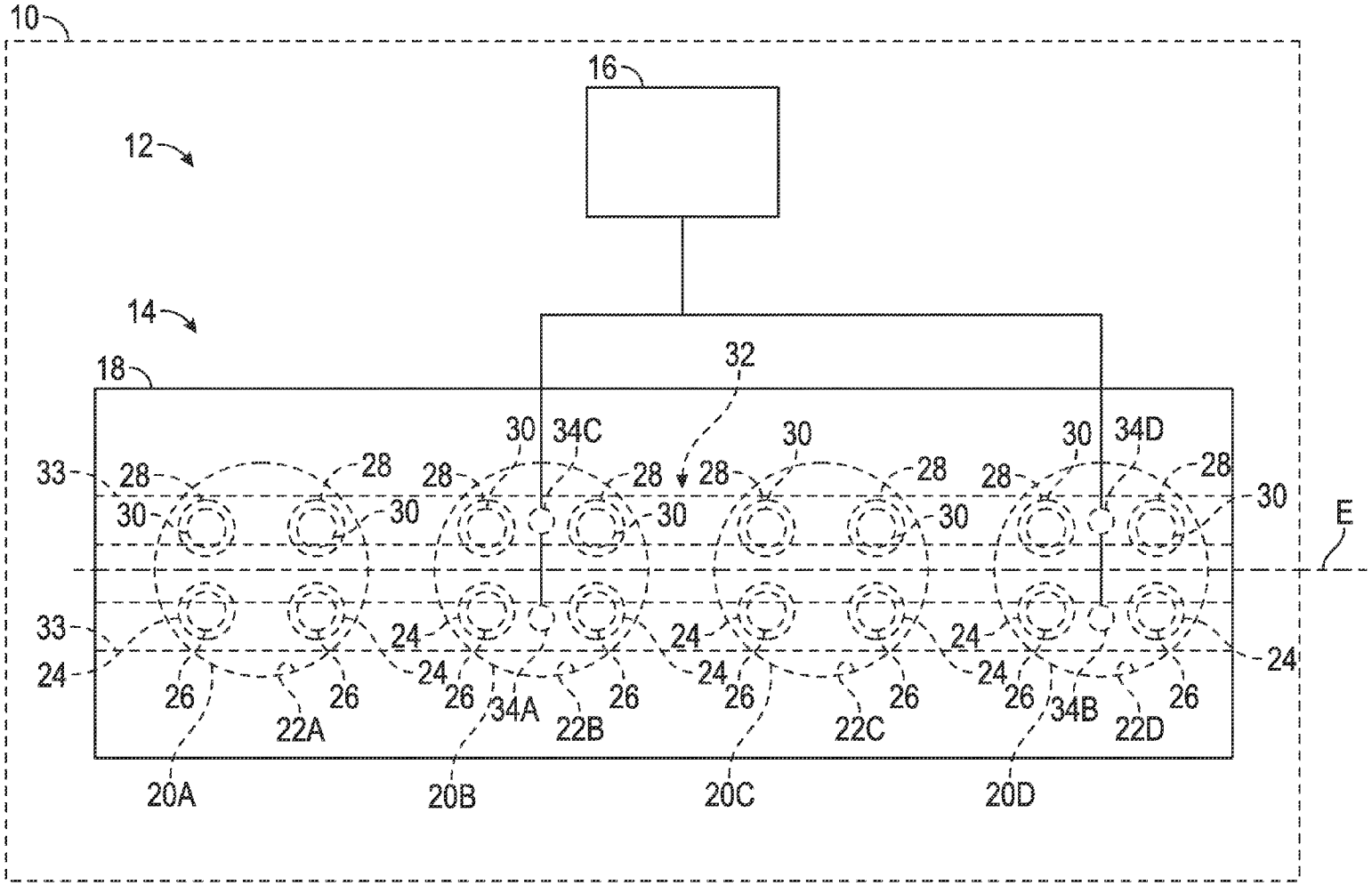
FIG. 1 is a schematic diagram of a vehicle including an engine assembly.

Referring to the drawings, wherein like reference numbers correspond to like or similar components throughout the several figures, FIG. 1 schematically illustrates a vehicle 10 such as a car, truck or motorcycle. The vehicle 10 includes an engine assembly 12. The engine assembly 12 includes an internal combustion engine 14 and a control module 16, such an engine control module (ECU), in electronic communication with the internal combustion engine 14. The terms "control module," "module," "control," "controller," "control unit," "processor" and similar terms mean any one or various combinations of one or more of Application Specific Integrated Circuit(s) (ASIC), electronic circuit(s), central processing unit(s) (preferably microprocessor(s)) and associated memory and storage (read only, programmable read only, random access, hard drive, etc.) executing one or more software or firmware programs or routines, combinational logic circuit(s), sequential logic circuit(s), input/output circuit(s) and devices, appropriate signal conditioning and buffer circuitry, and other components to provide the described functionality. "Software," "firmware," "programs," "instructions," "routines," "code," "algorithms" and similar terms mean any controller executable instruction sets including calibrations and look-up tables. The control module 16 may have a set of control routines executed to provide the desired functions. Routines are executed, such as by a central processing unit, and are operable to monitor inputs from sensing devices and other networked control modules, and execute control and diagnostic routines to control operation of actuators. Routines may be executed based on events or at regular intervals.

The internal combustion engine 14 includes an engine block 18 defining a plurality of cylinders 20A, 20B, 20C, and 20D. In other words, the engine block 18 includes a first cylinder 20A, a second cylinder 20B, a third cylinder 20C, and a fourth cylinder 20D. Although FIG. 1 schematically illustrates four cylinders, the internal combustion engine 14 may include more or fewer cylinders. The cylinders 20A, 20B, 20C, and 20D are spaced apart from each other but may be substantially aligned along an engine axis E. Each of the cylinders 20A, 20B, 20C, and 20D is configured, shaped and sized to receive a piston (not shown). The pistons are configured to reciprocate within the cylinders 20A, 20B, 20C, and 20D. Each cylinder 20A, 20B, 20C, 20D defines a corresponding combustion chamber 22A, 22B, 22C, 22D. During operation of the internal combustion engine 14, an air/fuel mixture is combusted inside the combustion chambers 22A, 22B, 22C, and 22D in order to drive the pistons in a reciprocating manner. The reciprocating motion of the pistons drives a crankshaft (not shown) operatively connected to the wheels (not shown) of the vehicle 10. The rotation of the crankshaft can cause the wheels to rotate, thereby propelling the vehicle 10.

In order to propel the vehicle 10, an air/fuel mixture should be introduced into the combustion chambers 22A, 22B, 22C, and 22D. To do so, the internal combustion engine 14 includes a plurality of intake ports 24 fluidly coupled to an intake manifold (not shown). In the depicted embodiment, the internal combustion engine 14 includes two intake ports 24 in fluid communication with each combustion chamber 22A, 22B, 22C, and 22D. However, the internal combustion engine 14 may include more or fewer intake ports 24 per combustion chamber 22A, 22B, 22C, and 22D. The internal combustion engine 14 includes at least one intake port 24 per cylinder 20A, 20B, 20C, 20D.

The internal combustion engine 14 further includes a plurality of intake valves 26 configured to control the flow of inlet charge through the intake ports 24. The number of intake valves 26 corresponds to the number of intake ports 24. Each intake valve 26 is at least partially disposed within a corresponding intake port 24. In particular, each intake valve 26 is configured to move along the corresponding intake port 24 between an open position and a closed position. In the open position, the intake valve 26 allows inlet charge to enter a corresponding combustion chamber 22A, 22B, 22C, or 22D via the corresponding intake port 24. Conversely, in the closed position, the intake valve 26 precludes the inlet charge from entering the corresponding combustion chamber 22A, 22B, 22C, or 22D via the intake port 24.

As discussed above, the internal combustion engine 14 can combust the air/fuel mixture once the air/fuel mixture enters the combustion chamber 22A, 22B, 22C, or 22D. For example, the internal combustion engine 14 can combust the air/fuel mixture in the combustion chamber 22A, 22B, 22C, or 22D using an ignition system (not shown). This combustion generates exhaust gases. To expel these exhaust gases, the internal combustion engine 14 defines a plurality of exhaust ports 28. The exhaust ports 28 are in fluid communication with the combustion chambers 22A, 22B, 22C, or 22D. In the depicted embodiment, two exhaust ports 28 are in fluid communication with each combustion chamber 22A, 22B, 22C, or 22D. However, more or fewer exhaust ports 28 may be fluidly coupled to each combustion chamber 22A, 22B, 22C, or 22D. The internal combustion engine 14 includes at least one exhaust port 28 per cylinder 20A, 20B, 20C, or 20D.

The internal combustion engine 14 further includes a plurality of exhaust valves 30 in fluid communication with the combustion chambers 22A, 22B, 22C, or 22D. Each exhaust valve 30 is at least partially disposed within a corresponding exhaust port 28. In particular, each exhaust valve 30 is configured to move along the corresponding exhaust port 28 between an open position and a closed position. In the open position, the exhaust valve 30 allows the exhaust gases to escape the corresponding combustion chamber 22A, 22B, 22C, or 22D via the corresponding exhaust port 28. The vehicle 10 may include an exhaust system (not shown) configured to receive and treat exhaust gases from the internal combustion engine 14. In the closed position, the exhaust valve 30 precludes the exhaust gases from exiting the corresponding combustion chamber 22A, 22B, 22C, or 22D via the corresponding exhaust port 28.

As discussed in detail below, intake valve 26 and exhaust valve 30 can also be generally referred to as engine valves 66 (FIG. 7) or simply valves. Each valve 66 (FIG. 7) is operatively coupled or associated with a cylinder 20A, 20B, 20C, or 20D. Accordingly, the valves 66 (FIG. 7) are configured to control fluid flow (i.e., air/fuel mixture for intake valves 26 and exhaust gas for exhaust valve 30) to the corresponding cylinder 20A, 20B, 20C, or 20D. The valves 66 operatively coupled to the first cylinder 20A can be referred to as first valves. The valves 66 operatively coupled to the second cylinder 20B can be referred to as second valves. The valves 66 operatively coupled to the third cylinder 20C can be referred to as third valves. The valves 66 operatively coupled to the fourth cylinder 20D can be referred to as fourth valves.

The engine assembly 12 further includes a valvetrain system 32 configured to control the operation of the intake valves 26 and exhaust valves 30. Specifically, the valvetrain system 32 can move the intake valves 26 and exhaust valves 30 between the open and closed positions based at least in part on the operating conditions of the internal combustion engine 14 (e.g., engine speed). The valvetrain system 32 includes one or more camshaft assemblies 33 substantially parallel to the engine axis E. In the depicted embodiment, the valvetrain system 32 includes two camshaft assemblies 33. One camshaft assembly 33 is configured to control the operation of the intake valves 26, and the other camshaft assembly 33 can control the operation of the exhaust valves 30. It is contemplated, however, that the valvetrain system 32 may include more or fewer camshaft assemblies 33.

In addition to the camshaft assemblies 33, the valvetrain assembly 32 includes a plurality of actuators 34A, 34B, 34C, 34D, such as solenoids, in communication with the control module 16. The actuators 34A, 34B may be electronically connected to the control module 16 and may therefore be in electronic communication with the control module 16. The control module 16 may be part of the valvetrain system 32. In the depicted embodiment, the valvetrain system 32 includes first, second, third, and fourth actuators 34A, 34B, 34C, 34D. The first actuator 34A is operatively associated with the first and second cylinders 20A, 20B and can be actuated to control the operation of the intake valves 26 of the first and second cylinders 20A, 20B. The second actuator 34B is operatively associated with the third and fourth cylinders 20C and 20D and can be actuated to control the operation of the intake valves 26 of the third and fourth cylinders 20C and 20D. The third actuator 34C is operatively associated with the first and second cylinders 20A and 20B and can be actuated to control the operation of the exhaust valves 30 of the first and second cylinders 20A and 20B. The fourth actuator 34C is operatively associated with the second and third cylinders 20C and 20D and can be actuated to control the operation of the exhaust valves 30 of the second and third cylinders 20C and 20D. The actuators 34A, 34B, 34C, 34D and control module 16 may be deemed part of the camshaft assembly 33.

Figure 2:
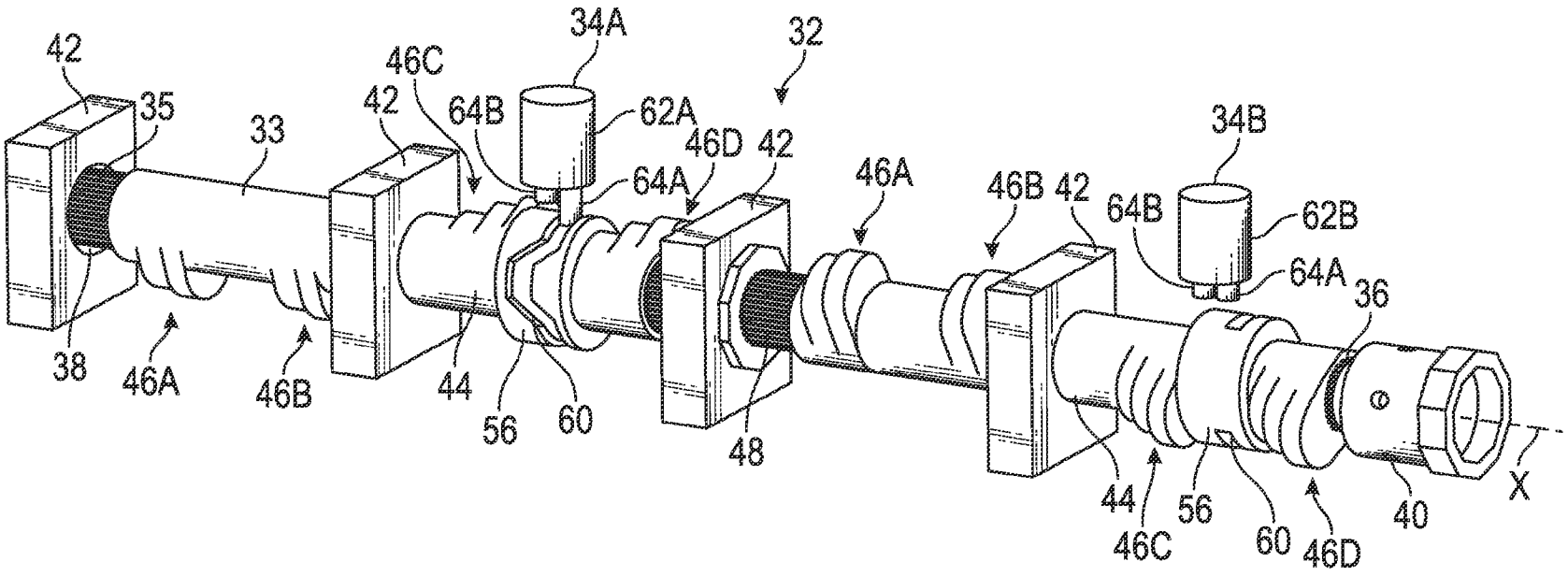
FIG. 2 is a schematic perspective view of a camshaft assembly of the engine assembly of FIG. 1 in accordance with an embodiment of the present disclosure.

With reference to FIG. 2, the valvetrain system 32 includes the camshaft assembly 33 and the actuators 34A, 34B as discussed above. The camshaft assembly 33 includes a base shaft 35 extending along a longitudinal axis X. Thus, the base shaft 35 extends along the longitudinal axis X. The base shaft 35 may also be referred to as the support shaft and includes a first shaft end portion 36 and a second shaft end portion 38 opposite the first shaft end portion 36.

Moreover, the camshaft assembly 33 includes a coupler 40 connected to the first shaft end portion 36 of the base shaft 35. The coupler 40 can be used to operatively couple the base shaft 35 to the crankshaft (not shown) of the engine 14. The crankshaft of the engine 14 can drive the base shaft 35. Accordingly, the base shaft 35 can rotate about the longitudinal axis X when driven by, for example, the crankshaft of the engine 14. The rotation of the base shaft 35 causes the entire camshaft assembly 33 to rotate about the longitudinal axis X. The base shaft 35 is therefore operatively coupled to the internal combustion engine 14.

The camshaft assembly 33 may additionally include one or more bearings 42, such as journal bearings, coupled to a fixed structure, such as the engine block 18. The bearings 42 may be spaced apart from one another along the longitudinal axis. X. In the depicted embodiment, the camshaft assembly 33 includes four bearings 42. It is envisioned, however, that the camshaft assembly 33 may include more or fewer bearings 42. At least one bearing 42 may be at the second shaft end portion 38.

The camshaft assembly 33 further includes one or more axially movable structures 44 mounted on the base shaft 35. The axially movable structures 44 may also be referred to as the lobe pack assemblies. The axially movable structures 44 are configured to move axially relative to the base shaft 35 along the longitudinal axis X. However, the axially movable structures 44 are rotationally fixed to the base shaft 35. Consequently, the axially movable structures 44 rotate synchronously with the base shaft 35. The base shaft 35 may include a spline feature 48 for maintaining angular alignment of the axially movable structures 44 to the base shaft 35 and also for transmitting drive torque between the base shaft 35 and the axially movable structures 44.

In the depicted embodiment, the camshaft assembly 33 includes two axially movable structures 44. It is nevertheless contemplated that the camshaft assembly 33 may include more or fewer axially movable structures 44. Regardless of the quantity, the axially movable structures 44 are axially spaced apart from each other along the longitudinal axis X. The axially movable structures 44 may also be referred to as sliding members because these members can slide along the base shaft 35.

Figure 3:
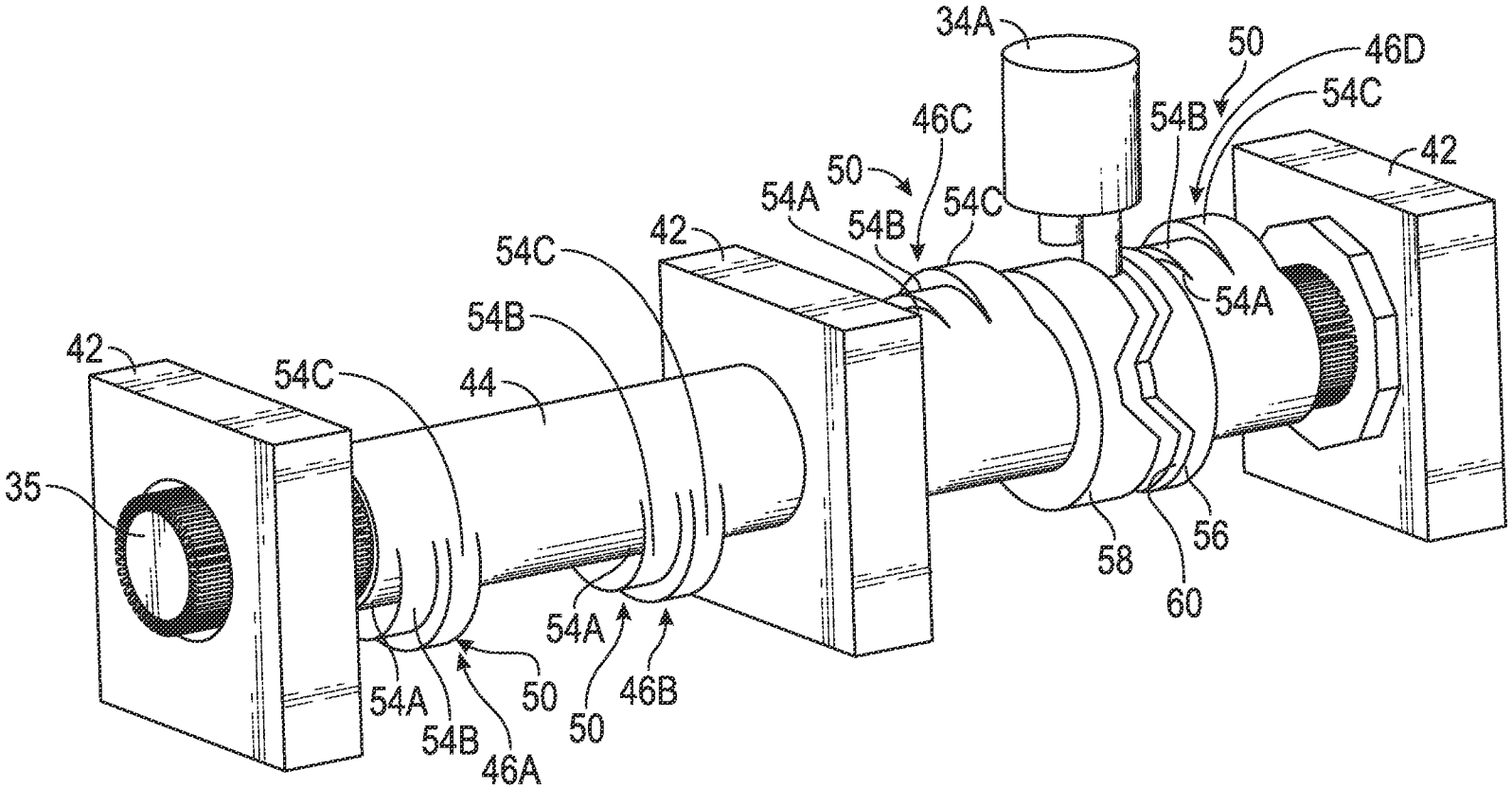
FIG. 3 is a schematic perspective view of a portion of the camshaft assembly of FIG. 2.

With specific reference to FIG. 3, each axially movable structure 44 includes a first lobe pack 46A, a second lobe pack 46B, a third lobe pack 46C, and a fourth lobe pack 46D coupled to one another. The first, second, third, and fourth lobe packs 46A, 46B, 46C, 46D may also be referred to as cam packs. In addition, each axially movable structure 44 only includes a single barrel cam 56. Each barrel cam 56 defines a control groove 60. Each axially movable structure 44 may be a monolithic structure. Accordingly, the first, second, third, and fourth lobe packs 46A, 46B, 46C of the same axially movable structure 44 can move simultaneously relative to the base shaft 35. The lobe packs 46A, 46B, 46C are nevertheless rotationally fixed to the base shaft 35. Consequently, the lobe packs 46A, 46B, 46C, 46D can rotate synchronously with the base shaft 35. Though the drawings show that each axially movable structure 44 includes three lobe packs 46A, 46B, 46C, 46D, each axially movable structure 44 may include more or fewer lobe packs.

The first, second, third, and fourth lobe packs 46A, 46B, 46C, 46D each include only one group of cam lobes 50. The barrel cam 56 disposed between the third and fourth lobe packs 46C, 46D. Each axially movable member 44 includes only one barrel cam 56.

The barrel cam 56 is axially disposed between the third and fourth lobe packs 46C, 46D. The two groups of lobes 50 of the third and fourth lobe pack 46C, 46D are axially spaced apart from each other. Each axially movable structure 44 has only one barrel cam 56.

Each group of cam lobes 50 includes a first cam lobe 54A, a second cam lobe 54B, and a third cam lobe 54C. It is envisioned that each group of cam lobes 50 may include more cam lobes. The cam lobes 54A, 54B, 54C have a typical cam lobe form with a profile that defines different valve lifts in three discrete steps. As a non-limiting example, one cam lobe profile may be circular (e.g., zero lift profile) in order to deactivate a valve (e.g., intake and exhaust valves 26, 30). The cam lobes 54A, 54B, 54C may have different lobe heights as discussed in detail below.

The barrel cam 56 includes a barrel cam body 58 and defines a control groove 60 extending into the barrel cam body 58. The control groove 60 is elongated along at least a portion of the circumference of the respective barrel cam body 58. Thus, the control groove 60 is circumferentially disposed along the respective barrel cam body 58. Further, the control groove 60 is configured, shaped, and sized to interact with one of the actuators 34A, 34B. As discussed in detail below, the interaction between the actuator 34A, 34B causes the axially movable structure 44 (and thus the lobe packs 46A, 46B, 46C, 46D) to move axially relative to the base shaft 35.

With reference to FIGS. 2 and 3, each actuator 34A, 34B includes an actuator body 62A, 62B, and first and second pins 64A, 64B movably coupled to the actuator body 62A, 62B. The first and second pins 64A, 64B of each actuator 34A, 34B are axially spaced apart from each other and can move independently from each other. Specifically, each of the first and second pins 64A, 64B can move relative to the corresponding actuator body 62A, 62B between a retracted position and an extended position in response to an input or command from the control module 16 (FIG. 1). In the retracted position, the first or second pin 64A or 64B is not disposed in the control groove 60. Conversely, in the extended position, the first or second pin 64A or 64B can be at least partially disposed in the control groove 60. Accordingly, the first and second pins 64A, 64B can move toward and away from the control groove 60 of the barrel cam 56 in response to an input or command from the control module 16 (FIG. 1). Hence, the first and second pins 64A, 64B of each actuator 34A, 34B can move relative to a corresponding barrel cam 56 in a direction substantially perpendicular to the longitudinal axis X.

Figure 4:
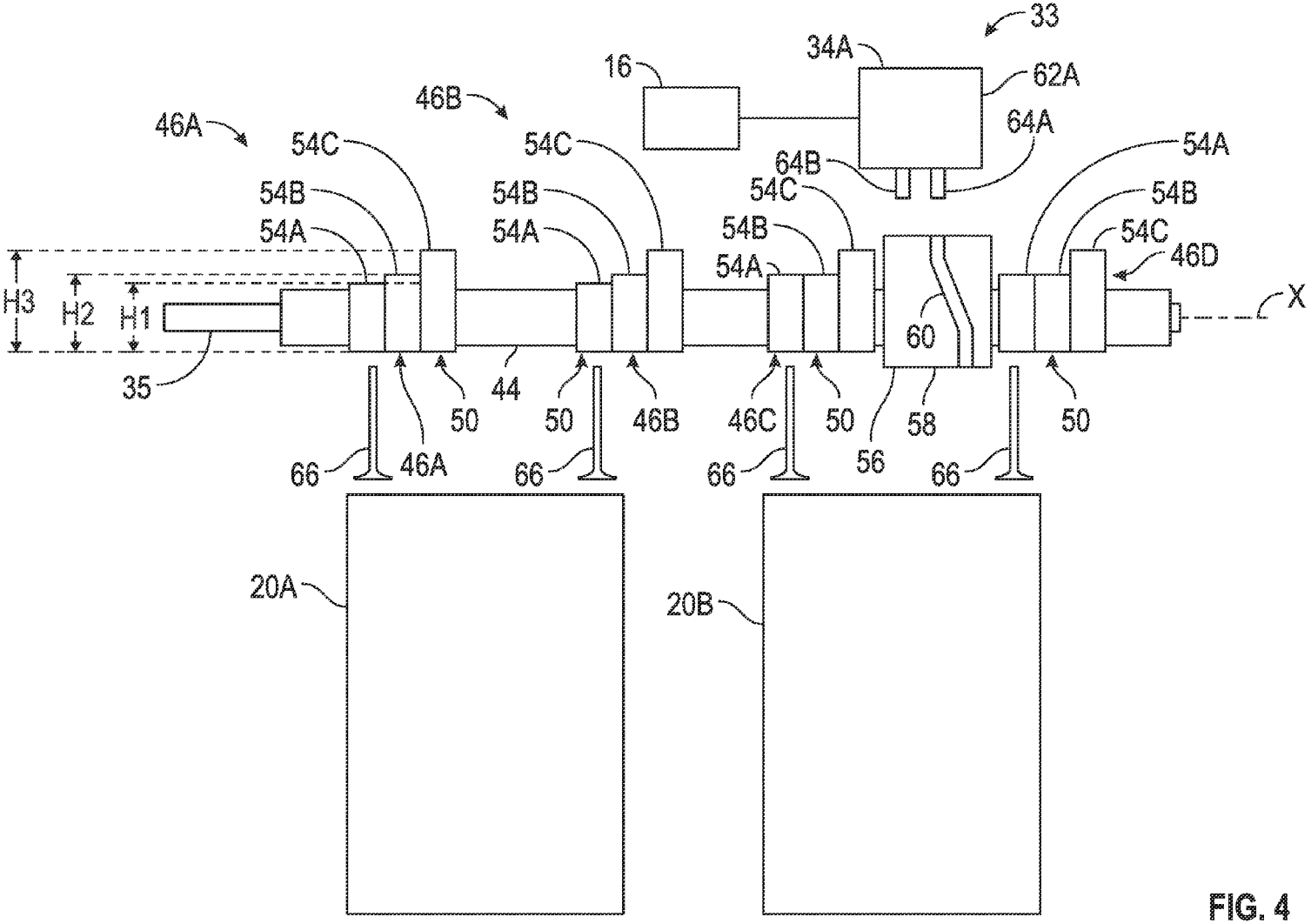
FIG. 4 is a schematic side view of a portion of the camshaft assembly and two engine cylinders, showing the lobe packs of the camshaft assembly in a first position.

With reference to FIG. 4, the camshaft assembly 33 includes at least one axially movable structure 44. Though FIG. 4 shows only one axially movable structure 44, it is contemplated that the camshaft assembly 33 may include more axially movable structures. The first and second lobe packs 46A, 46B are operatively associated with one cylinder 20A of the engine 14 (FIG. 1), while the third lobe pack 46C is operatively associated with another cylinder 20B of the engine 14. The axially movable structure 44 may also include more or fewer than four lobe packs 46A, 46B, 46C, 46D. Regardless of the number of lobe packs, each axially movable structure 44 may only include a single barrel cam 56. Accordingly, the camshaft assembly 33 may only include one barrel cam 56 for every two cylinders 20A, 20B. Because the barrel cam 56 interacts with one actuator 34A to move the axially movable structure 44 relative to the base shaft 35, the camshaft assembly 33 may only include a single actuator 34A (or 34B) for every two cylinders 20A, 20C. In other words, the camshaft assembly 33 may include a single actuator 34A for every two cylinders 20A, 20B. It is useful to have only one barrel cam 56 and only one actuator 34A for every two cylinders 20A, 20B in order to minimize manufacturing costs. It is also useful to have only one barrel cam 56 in each axially movable structure 44 in order to minimize manufacturing costs.

As discussed above, the first, second, third, and fourth lobe packs 46A, 46B, 46C, 46D each include one group of cam lobes 50. Each group of cam lobes 50, 52 includes a first cam lobe 54A, a second cam lobe 54B, and a third cam lobe 54C. The first cam lobe 54A may have a first maximum lobe height H1. The second cam lobe 54B has a second maximum lobe height H2. The third cam lobe 54C has a third maximum lobe height H3. The first, second, and third maximum lobe heights H1, H2, H3 may be different from one another. In the embodiment depicted in FIG. 4, the first, second, and third cam lobes 54A, 54B, 54C of the first and second lobe packs 46A, 46B have different maximum lobe heights, but the first and second cam lobes 54A, 54B of the third lobe pack 46C have the same maximum lobe heights. In other words, the first maximum lobe height H1 may be equal to the second maximum lobe height H2. Alternatively, the first maximum lobe height H1 may be different from the second maximum lobe height H2. The maximum lobe heights of the cam lobes 54A, 54B, 54C corresponds to the valve lift of the intake and exhaust valves 26, 30. The camshaft assembly 33 can adjust the valve lift of the intake and exhaust valves 26, 30 by adjusting the axial position of the cam lobes 54A, 54C, 54D relative to the base shaft 35. This can include a zero lift cam profile if desired. The cam lobes 54A, 54B, 54C of each group of cam lobes 50 are disposed in different axial positions along the longitudinal axis X.

Figure 5:
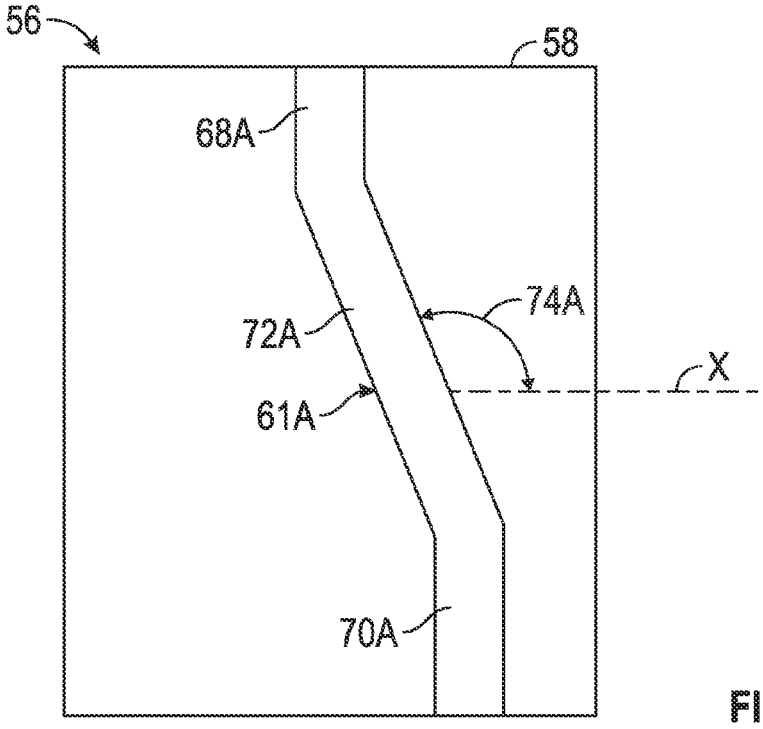
FIG. 5 is a schematic side view a of a barrel cam of the camshaft assembly shown in FIG. 4, depicting only a portion of the arc length of a control groove of the barrel cam.
Figure 10:
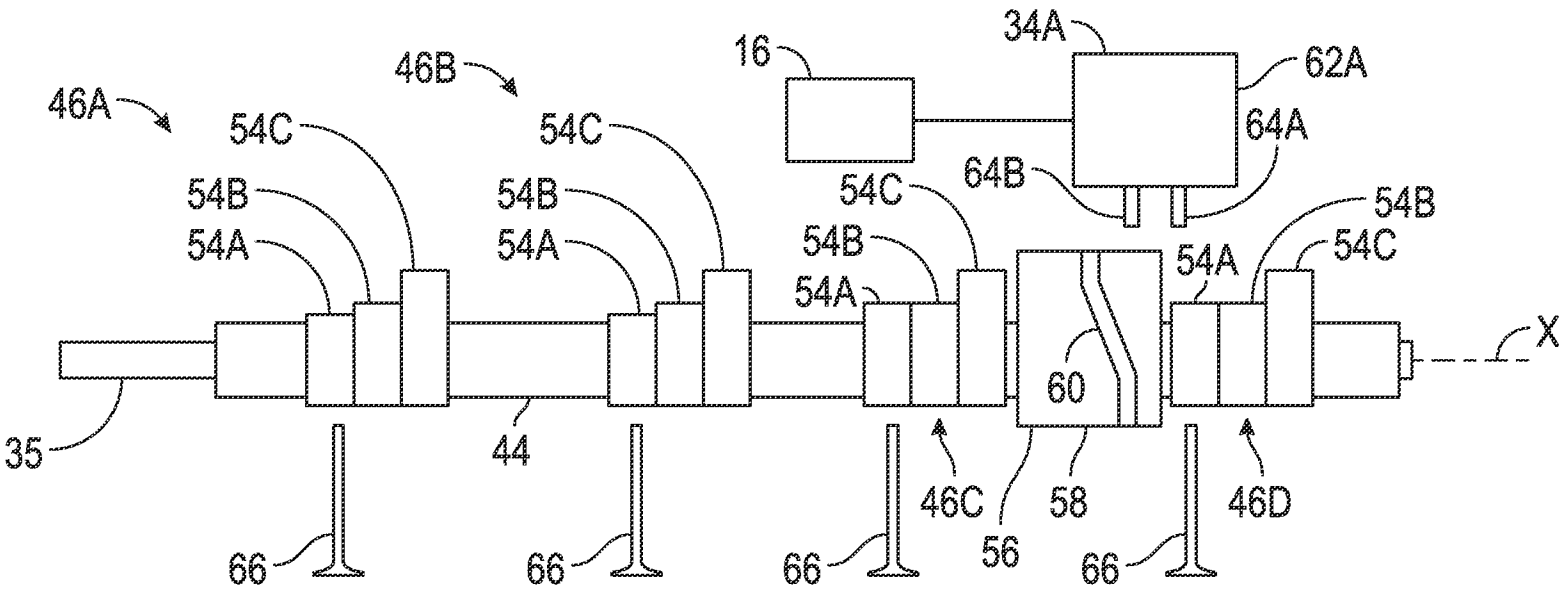
FIG. 10 is a schematic side view of the camshaft assembly shown in FIG. 4, showing the lobe packs in a third position.

With reference to FIGS. 4-5, the lobe pack 46A, 46B, 46C, 46D can move relative to the base shaft 35 between a first position (FIG. 4), a second position (FIG. 8), and a third position (FIG. 10). To do so, the barrel cam 56 can physically interact with the actuator 34A. As discussed above, the barrel cam 56 includes a barrel cam body 58 and defines a control groove 60 extending into the barrel cam body 58. The control groove 60 is elongated along at least a portion of the circumference of the respective barrel cam body 58.

FIG. 5 schematically illustrates a first section 61A of the control groove 60, thereby showing only a portion of the arc length of the control groove 60 of the barrel cam 56. The first section 61A of the control groove 60 includes a first groove portion 68A, a second groove portion 70A, and a third groove portion 72A disposed between the first groove portion 68A and second groove portion 70A. The first groove portion 68A is axially spaced from the second groove portion 70A and is substantially perpendicular to the longitudinal axis X. The second groove portion 72A is also substantially perpendicular to the longitudinal axis X. The third groove portion 72A interconnects the first groove portion 68A and second groove portion 70A and is obliquely angled relative to the longitudinal axis X. Specifically, the third groove portion 72A defines a first oblique angle 74A relative to the longitudinal axis X. During operation of the camshaft assembly 33, the lobe packs 46A, 46B, 46C can move axially relative to the base shaft 35 when one of the actuator pins 64A, 64B is disposed in the third groove portion 72A and the base shaft 35 is rotating about the longitudinal axis X. The shape of the control groove 72A and 72B is illustrated as a simple oblique profile; however, the shape of the control grooves 72A and 72B can also be contoured as required to control the axial movement of the lobe packs 46A, 46B, 46C. The shape of the control groove 60 defines the velocity and force associated with the axial movement of the lobe packs 46A, 46B, 46C. After moving the lobe packs 46A, 46B, 46C, the lobe packs 46A, 46B, 46C can be maintained in a fixed axial position relative to the base shaft 35 by a detent feature. Specifically, the base shaft 35 includes a detent feature (e.g., ball and spring, riding in groove) that is used to maintain the lobe packs 46A, 46B, 46C at a fixed axial position relative to the base shaft 35 when none of the actuator pins 64A, 64B are in the extended position.

Figure 6:
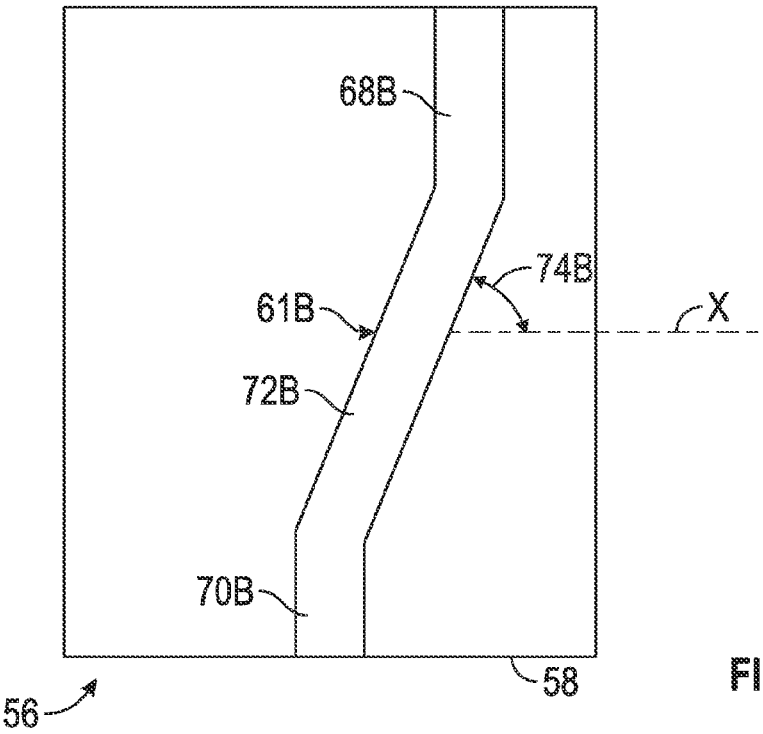
FIG. 6 is a schematic side view of a barrel cam shown in FIG. 5, depicting another portion of the arc length of a control groove of the barrel cam.

FIG. 6 schematically illustrates a second section 61B of the control groove 60, thereby showing only a portion of the arc length of the control groove 60 of the barrel cam 56. The second section 61B includes a first groove portion 68B, a second groove portion 70B, and a third groove portion 72B disposed between the first groove portion 68B and second groove portion 70B. The first groove portion 68B is axially spaced from the second groove portion 70B and is substantially perpendicular to the longitudinal axis X. The second groove portion 72B is also substantially perpendicular to the longitudinal axis X. The third groove portion 72B interconnects the first groove portion 68B and second groove portion 70B and is obliquely angled relative to the longitudinal axis X. Specifically, the third groove portion 72B defines a second oblique angle 74B relative to the longitudinal axis X. The first and second oblique angles 74A, 74B are supplementary angles. For example, the first oblique angle 74A may be less than the second oblique angle 74B. During operation of the camshaft assembly 33, the lobe packs 46A, 46B, 46C can move axially relative to the base shaft 35 when one of the actuator pins 64A, 64B is disposed in the third groove portion 72B and the base shaft 35 is rotating about the longitudinal axis X.

In FIG. 4, the axially movable structure 44 is in a first position relative to the base shaft 35. When the axially movable structure 44 in the first position relative to the base shaft 35, the lobe packs 46A, 46B, 46C, 46D are in the first position and, the first cam lobe 54A of each lobe pack 46A, 46B, 46C, 46D is substantially aligned with the engine valves 66. The engine valves 66 represent intake or exhaust valves 26, 30 as described above. In the first position, the first cam lobes 54A are operatively coupled to the engine valves 66. As such, the engine valves 66 have a valve lift that corresponds to the first maximum lobe height H1, which is herein referred to as a first valve lift. In other words, when the lobe packs 46A, 46B, 46C, 46D are in the first position, the engine valves 66 have a first valve lift, which corresponds to the first maximum lobe height H1.

During operation, the axially movable structure 44 and the lobe packs 46A, 46B, 46C, 46D can move between a first position (FIG. 4), a second position (FIG. 8) and a third position (FIG. 10) to adjust the valve lift of the engine valves 66. As discussed above, in the first position (FIG. 4), the first cam lobes 54A are substantially aligned with the engine valves 66. The rotation of the lobe pack 46A, 46B, 46C, 46D causes the engine valves 66 to move between the open and closed positions. When the lobe packs 46A, 46B, 46C, 46D are in the first position (FIG. 4), the valve lift of the engine valves 66 may be proportional to the first maximum lobe height H1.

Figure 7:
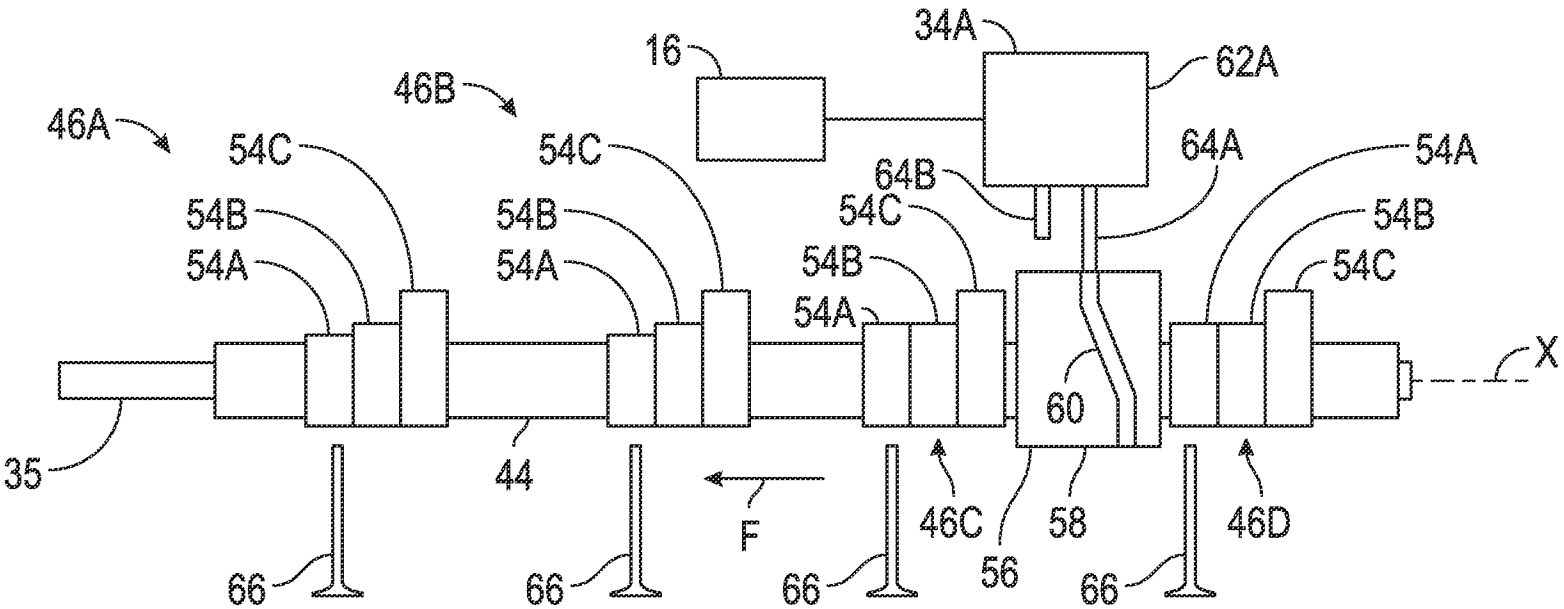
FIG. 7 is a schematic side view of the camshaft assembly shown in FIG. 4, showing a first pin of a first actuator partially disposed in a first section of the control groove.

To move the axially movable structure 44 from the first position (FIG. 4) to the second position (FIG. 8), the control module 16 can command the actuator 34A to move its first pin 64A from the retracted position to the extended position while the base shaft 35 rotates about the longitudinal axis X as shown in FIG. 7. In the extended position, the first pin 64A is at least partially disposed in the control groove 60. The control groove 60 is therefore configured, shaped, and sized to receive the first pin 64A when the first pin 64A is in the extended position. At this point, the first pin 64A of the actuator 34A rides along the first section 61A (FIG. 5) of the control groove 60 as the lobe packs 46A, 46B, 46C rotate about the longitudinal axis X. As the first pin 64A rides along the first section 61A (FIG. 5) of the control groove 60, the axially movable structure 44 and the lobe packs 46A, 46B move axially relative to the base shaft 35 from the first position (FIG. 4) to the second position (FIG. 8) in a first direction F. Because the control groove 60 has a varying depth, the first pin 64A of the actuator 34A can be moved mechanically to its retracted position as the first pin 64A rides along the control groove 60. Alternatively, the control module 16 can command the first actuator 34A to move the first pin 64A to the retracted position.

Figure 8:
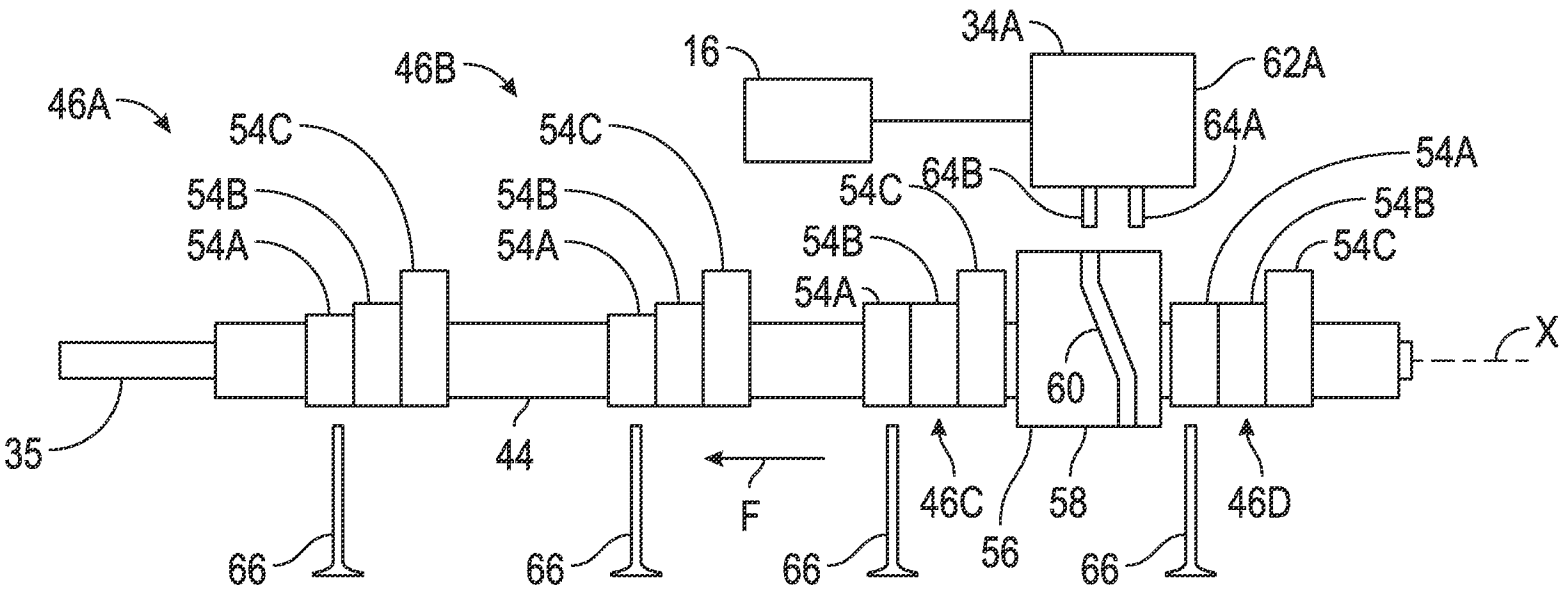
FIG. 8 is a schematic side view of the camshaft assembly shown in FIG. 4, showing the lobe packs in a second position.

In FIG. 8, the axially movable structure 44 is in a second position relative to the base shaft 35. When the axially movable structure 44 in the second position relative to the base shaft 35, the lobe packs 46A, 46B, 46C, 46D are in the second position and, the second cam lobe 54B of each lobe pack 46A, 46B, 46C, 46D is substantially aligned with the engine valves 66. The engine valves 66 represent intake or exhaust valves 26, 30 as described above. In the second position, the second cam lobes 54B are operatively coupled to the engine valves 66. As such, the engine valves 66 have a valve lift that corresponds to the second maximum lobe height H2 (FIG. 4), which is herein referred to as a second valve lift. In other words, when the lobe packs 46A, 46B, 46C, 46D are in the second position, the engine valves 66 have a second valve lift, which corresponds to the second maximum lobe height H2.

Figure 9:
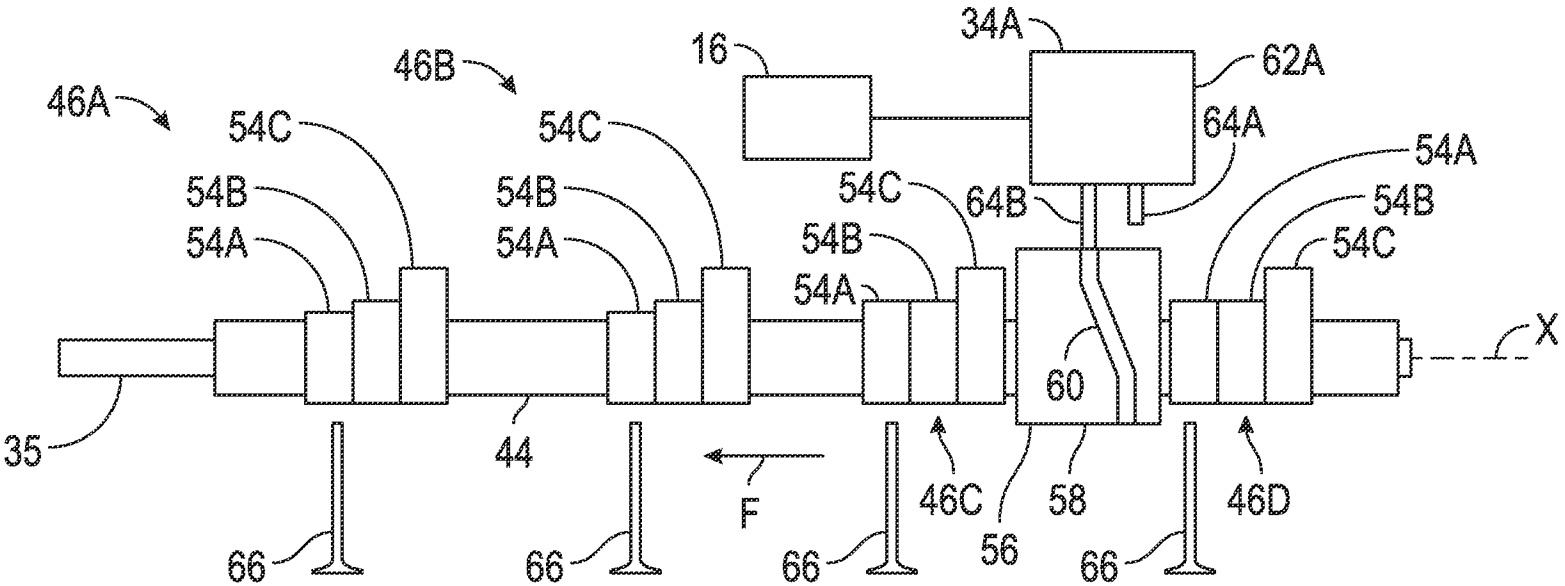
FIG. 9 is a schematic side view of the camshaft assembly shown in FIG. 4, showing a second pin of the actuator partially disposed in the first section of the control groove.

To move the axially movable structure 44 from the second position (FIG. 8) to the third position (FIG. 10), the control module 16 can command the first actuator 34A to move its second pin 64B from the retracted position to the extended position while the base shaft 35 rotates about the longitudinal axis X as shown in FIG. 9. In the extended position, the second pin 64B is at least partially positioned in the control groove 60. The control groove 60 is therefore configured, shaped, and sized to receive the second pin 64B when the second pin 64B is in the extended position. At this point, the second pin 64B of the actuator 34A rides along the first section 61A (FIG. 5) of the control groove 60 as the lobe packs 46A, 46B, 46C, 46D rotate about the longitudinal axis X. As the second pin 64B rides along the first section 61A of the control groove 60, the axially movable structure 44 and the lobe packs 46A, 46B, 46C, 46D move axially relative to the base shaft 35 from the second position (FIG. 8) to the third position (FIG. 10) in the first direction F. Because the control groove 60 has a varying depth, the second pin 64B of the actuator 34A can be moved mechanically to its retracted position as the second pin 64B rides along the control groove 60. Alternatively, the control module 16 can command the first actuator 34A to move the second pin 64B to the retracted position.

In FIG. 10, the axially movable structure 44 is in a third position relative to the base shaft 35. When the axially movable structure 44 in the third position relative to the base shaft 35, the lobe packs 46A, 46B, 46C, 46D are in the third position and the third cam lobe 54C of each lobe pack 46A, 46B, 46C, 46D is substantially aligned with the engine valves 66. The engine valves 66 represent intake or exhaust valves 26, 30 as described above. In the third position, the third cam lobes 54C are operatively coupled to the engine valves 66. As such, the engine valves 66 have a valve lift that corresponds to the third maximum lobe height H3 (FIG. 4), which is herein referred to as a third valve lift. In other words, when the lobe packs 46A, 46B, 46C, 46D are in the third position, the engine valves 66 have a third valve lift, which corresponds to the third maximum lobe height H3.

Figure 11:
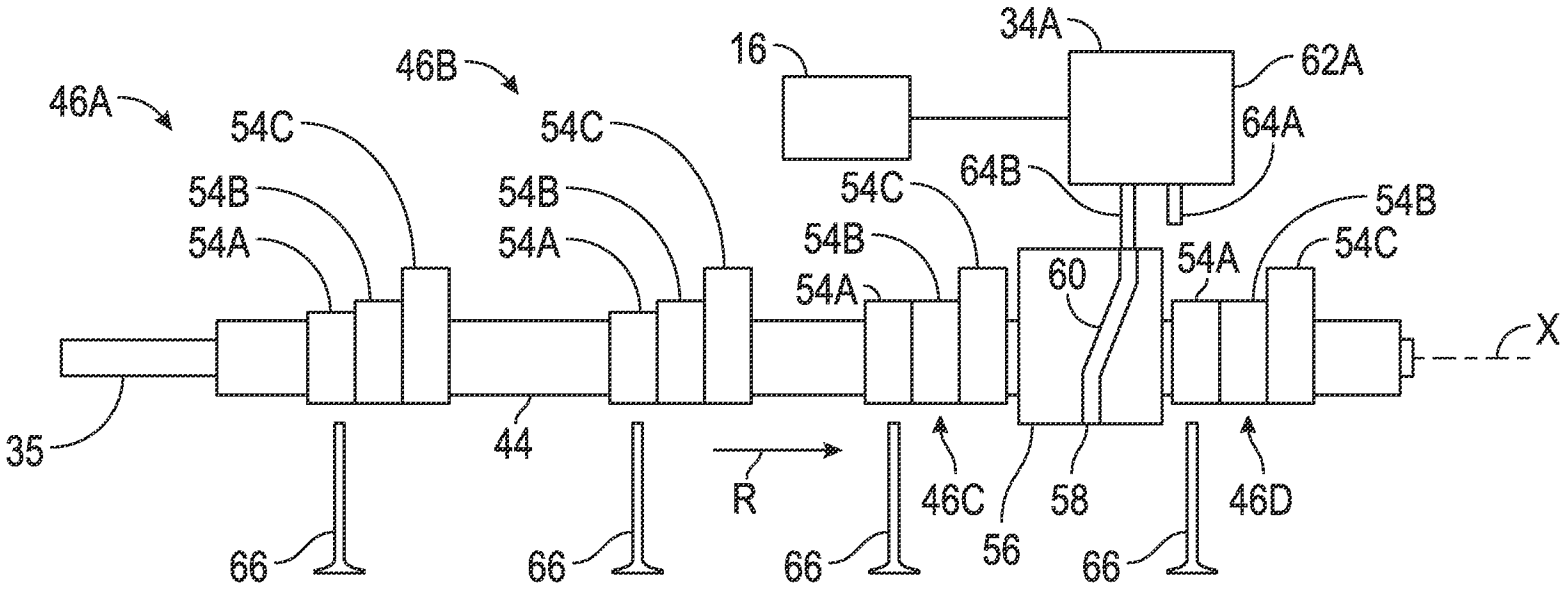
FIG. 11 is a schematic side view of the camshaft assembly shown in FIG. 4, showing the second pin of the actuator partially disposed in a second section of the control groove.

To move the axially movable structure 44 from the third position (FIG. 10) to the second position (FIG. 8), the control module 16 can command the actuator 34A to move its second pin 64B from the retracted position to the extended position while the base shaft 35 rotates about the longitudinal axis X as shown in FIG. 11. In the extended position, the second pin 64B is at least partially positioned in the control groove 60. At this point, the second pin 64B of the actuator 34A rides along the second section 61B (FIG. 6) of the control groove 60 as the lobe packs 46A, 46B, 46C, 46D rotate about the longitudinal axis X. As the second pin 64B rides along the second section 61B (FIG. 6) of the control groove 60, the axially movable structure 44 and the lobe packs 46A, 46B, 46C, 46D move axially relative to the base shaft 35 from the third position (FIG. 10) to the second position (FIG. 8) in a second direction R. Because the control groove 60 has a varying depth, the second pin 64B of the actuator 34A can be moved mechanically to its retracted position as the second pin 64B rides along the control groove 60. Alternatively, the control module 16 can command the first actuator 34A to move the second pin 64B to the retracted position.

Figure 12:
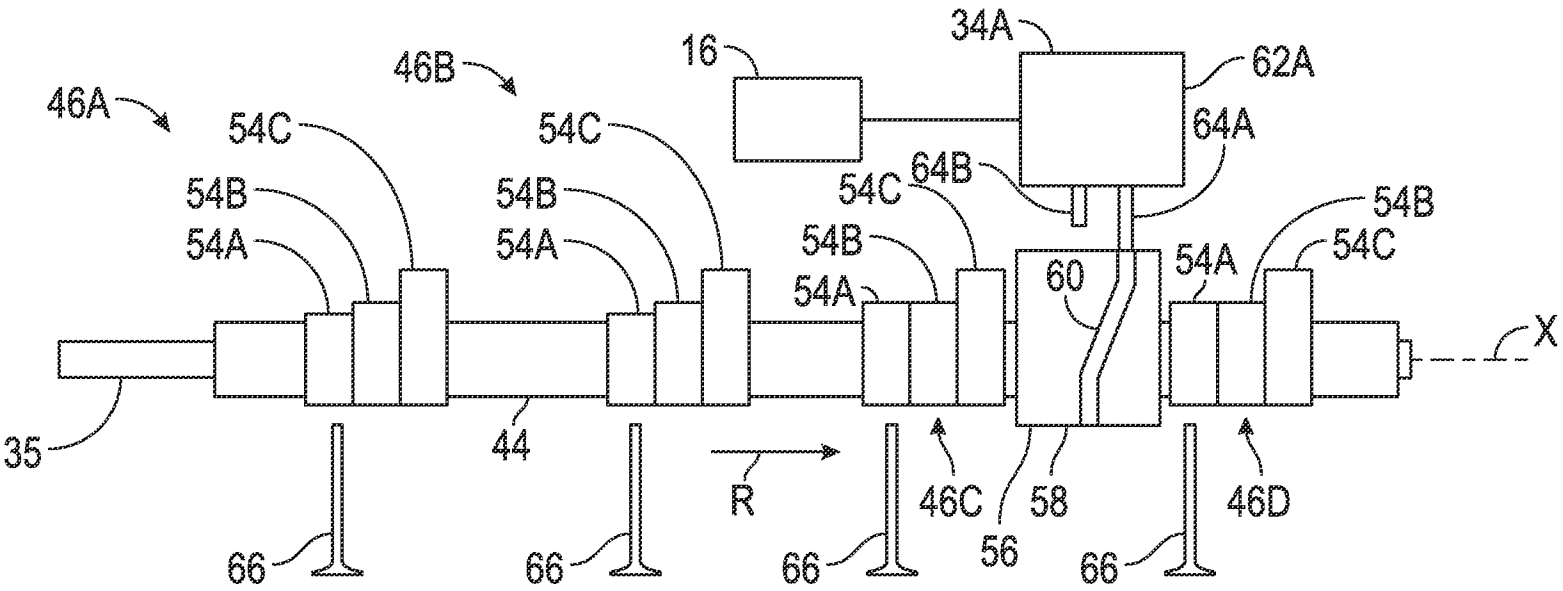
FIG. 12 is a schematic side view of the camshaft assembly shown in FIG. 4, showing the first pin of the actuator partially disposed in the second section of the control groove.

To move the axially movable structure 44 from the second position (FIG. 8) to the first position (FIG. 4), the control module 16 can command the actuator 34A to move its first pin 64A from the retracted position to the extended position while the base shaft 35 rotates about the longitudinal axis X as shown in FIG. 12. In the extended position, the first pin 64A is at least partially positioned in the control groove 60. At this point, the first pin 64A of the actuator 34A rides along the second section 61B (FIG. 6) of the control groove 60 as the lobe packs 46A, 46B, 46C, 46D rotate about the longitudinal axis X. As the first pin 64A rides along the second section 61B (FIG. 6) of the control groove 60, the axially movable structure 44 and the lobe packs 46A, 46B, 46C, 46D move axially relative to the base shaft 35 from the second position (FIG. 8) to the first position (FIG. 4) in the second direction R. Because the control groove 60 has a varying depth, the first pin 64A of the actuator 34A can be moved mechanically to its retracted position as the first pin 64A rides along the control groove 60. Alternatively, the control module 16 can command the first actuator 34A to move the first pin 64A to the retracted position.

Figure 13:
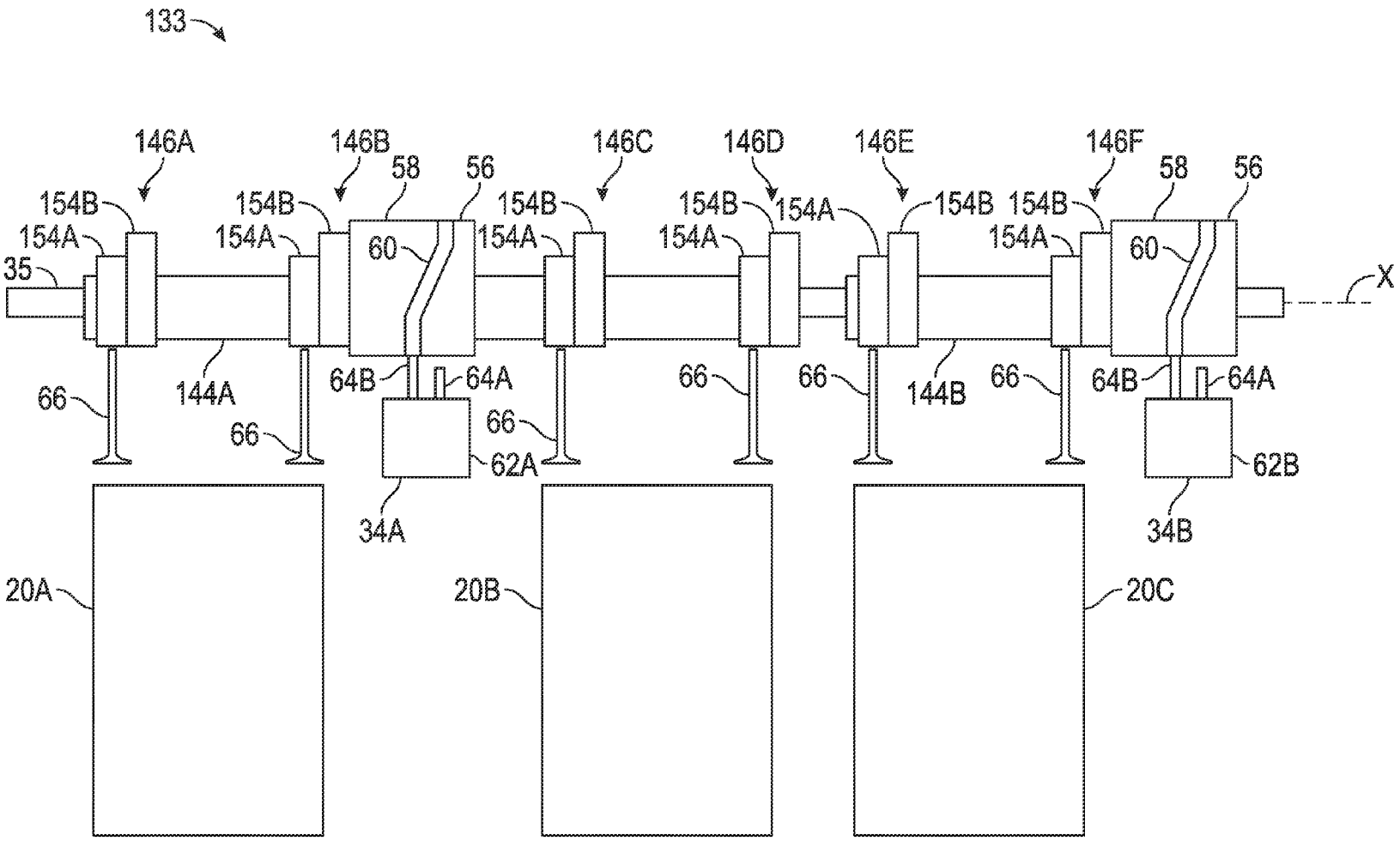
FIG. 13 is schematic side view of a camshaft assembly in accordance with another embodiment of the present disclosure.

FIG. 13 schematically illustrates a camshaft assembly 133 in accordance with another embodiment of the present disclosure. The structure and operation of the camshaft assembly 133 is similar to the structure and operation of the camshaft assembly 33 described above. In the interest of brevity, only the differences between the camshaft assembly 133 and the camshaft assembly 33 shown in FIG. 4 are described below.

With continued reference to FIG. 13, the camshaft assembly 133 includes a first axially movable structure 144A and a second axially movable structure 144B. The first and second axially movable structures 144A, 144B can move independently of each other along the longitudinal axis X. The first axially movable structure 144A is operatively associated with two cylinders 20A, 20B, whereas the second axially movable structure 144B is operatively associated with only one cylinder 20C.

The first axially movable structure 144A includes four lobe packs 146A, 146B, 146C, 146D axially spaced apart from one another along the longitudinal axis. Each of the lobe packs 146A, 146B, 146C, 146D of the first axially movable structure 144A includes two cam lobes 154A, 154B.

The first axially movable structure 144A includes a single barrel cam 56 in addition to the two cam lobes 154A, 154B. As discussed above, the barrel cam 56 includes a barrel cam body 58 and defines a control groove 60 extending into the barrel cam body 58. The barrel cam 56 can physically interact with the actuator 34A in order to move the axially movable structure 144A relative to the base shaft 35 as discussed in detail above.

The second axially movable structure 144B includes two lobe packs 146E, 146F. Each of the lobe packs 146E, 146F of the second axially movable structure 144B includes two cam lobes 154A, 154B. In addition, the second axially movable structure 144B includes a single barrel cam 56. The barrel cam 56 can physically interact with the actuator 34B in order to move the second axially movable structure 144B relative to the base shaft 35 as discussed in detail above.

The detailed description and the drawings or figures are supportive and descriptive of the invention, but the scope of the invention is defined solely by the claims. While some of the best modes and other embodiments for carrying out the claimed invention have been described in detail, various alternative designs and embodiments exist for practicing the invention defined in the appended claims.

The invention claimed is:

1. A camshaft assembly, comprising:

a base shaft extending along a longitudinal axis, the base shaft being configured to rotate about the longitudinal axis;

an axially movable structure mounted on the base shaft, the axially movable structure being axially movable relative to the base shaft, the axially movable structure being rotationally fixed to the base shaft, wherein the axially movable structure includes:

a plurality of lobe packs, each of the lobe packs including a plurality of cam lobes, wherein the axially movable structure includes only one barrel cam, the barrel cam defines a control groove, and the control groove defines a single path around a circumference of the barrel cam;

an actuator including an actuator body and first and second pins each movably coupled to the actuator body such that each of the first and second pins is movable relative to the actuator body between a retracted position and an extended position, wherein the first and second pins are configured to ride along the single path defined by the control groove;

wherein the axially movable structure is axially movable relative to the base shaft from a first position to a second position when the base shaft rotates about the longitudinal axis, the first pin is in the extended position, the first pin is at least partially disposed in the control groove, and the first pin rides along the single path defined by the control groove; and wherein the axially movable structure is axially movable relative to the base shaft from the second position to a third position when the base shaft rotates about the longitudinal axis, the second pin is in the extended position, the second pin is at least partially disposed in the control groove, and the second pin rides along the single path defined by the control groove.

2. The camshaft assembly of claim 1, further comprising a control module in communication with the actuator, wherein at least one of the first and second pins is configured to move between the retracted and extended positions in response to an input from the control module.

3. The camshaft assembly of claim 1, wherein the plurality of cam lobes includes first and second cam lobes axially spaced apart from each other.

4. The camshaft assembly of claim 3, wherein the plurality of cam lobes further includes a third cam lobe axially spaced apart from the first and second cam lobes.

5. The camshaft assembly of claim 4, wherein the first cam lobe has a first maximum lobe height, the second cam lobe has a second maximum lobe height, and the first maximum lobe height is different from the second maximum lobe height.

6. The camshaft assembly of claim 5, wherein the third cam lobe has a third maximum lobe height, and the second maximum lobe height is different from the third maximum lobe height.

7. The camshaft assembly of claim 5, wherein the third cam lobe has a third maximum lobe height, and the second maximum lobe height is the same as the third maximum lobe height.

8. An engine assembly, comprising:

an internal combustion engine including a first cylinder, a second cylinder, a first valve operatively coupled to the first cylinder, and a second valve operatively coupled to the second cylinder, wherein the first valve is configured to control fluid flow in the first cylinder, and the second valve is configured to control fluid flow in the second cylinder; and a camshaft assembly operatively coupled to the first and second valves, wherein the camshaft assembly includes:

a base shaft extending along a longitudinal axis, the base shaft being configured to rotate about the longitudinal axis;

an axially movable structure mounted on the base shaft, the axially movable structure being axially movable relative to the base shaft, the axially movable structure being rotationally fixed to the base shaft, wherein the axially movable structure includes:

a plurality of lobe packs, each of the lobe packs including a plurality of cam lobes, wherein the axially movable structure includes only one barrel cam, and the barrel cam defines only one control groove, wherein the control groove defines a single path around a circumference of the barrel cam;

an actuator including an actuator body and first and second pins each movably coupled to the actuator body such that each of the first and second pins is movable relative to the actuator body between a retracted position and an extended position, wherein the first and second pins are configured to ride along the single path defined by the control groove;

wherein the axially movable structure is axially movable relative to the base shaft in a first direction when the base shaft rotates about the longitudinal axis, the first pin is in the extended position, the first pin is at least partially disposed in the control groove, and the first pin rides along the single path defined by the control groove in order to adjust a valve lift profile of the first and second valves; and wherein the axially movable structure is axially movable relative to the base shaft in the first direction when the second pin is in the extended position, the second pin is at least partially disposed in the control groove, and the second pin rides along the single path defined by the control groove.

9. The engine assembly of claim 8, wherein the lobe packs are configured to rotate synchronously when the axially movable structure rotates along with the base shaft.

10. The engine assembly of claim 8, further comprising a control module in communication with the actuator, wherein at least one of the first and second pins is configured to move between the retracted and extended positions in response to an input from the control module.

11. The engine assembly of claim 8, wherein the plurality of cam lobes includes first and second cam lobes axially spaced apart from each other.

12. The engine assembly of claim 11, wherein the plurality of cam lobes further includes a third cam lobe axially spaced apart from the first and second cam lobes.

13. The engine assembly of claim 12, wherein the first cam lobe has a first maximum lobe height, the second cam lobe has a second maximum lobe height, and the first maximum lobe height is different from the second maximum lobe height.

14. The engine assembly of claim 13, wherein the third cam lobe has a third maximum lobe height, and the second maximum lobe height is different from the third maximum lobe height.

15. An engine assembly, comprising:

an internal combustion engine including a plurality of cylinders and a plurality of valves operatively coupled to the cylinders, wherein the valves are configured to control fluid flow in the cylinders; and a camshaft assembly operatively coupled to the valves, wherein the camshaft assembly includes:

a base shaft extending along a longitudinal axis, the base shaft being configured to rotate about the longitudinal axis;

an axially movable structure mounted on the base shaft, the axially movable structure being axially movable relative to the base shaft, the axially movable structure being rotationally fixed to the base shaft, wherein the axially movable structure includes:

a plurality of lobe packs, each of the lobe packs including a plurality of cam lobes, wherein the axially movable structure includes a barrel cam, and the barrel cam defines a control groove, wherein the control groove defines a single path around a circumference of the barrel cam;

a single actuator for every two cylinders, the actuator including an actuator body and first and second pins each movably coupled to the actuator body such that the first and second pins are each movable relative to the actuator body between a retracted position and an extended position, wherein the first and second pins are configured to ride along the single path defined by the control groove; and wherein the axially movable structure is axially movable relative to the base shaft when the base shaft rotates about the longitudinal axis, the at least one of the first and second pins is in the extended position, at least one of the first and second pins is at least partially disposed in the control groove, and at least one of the first and second pins rides along the single path defined by the control groove in order to adjust a valve lift profile of the valves.

16. The engine assembly of claim 15, wherein the camshaft assembly includes only one barrel cam for every actuator.

17. The engine assembly of claim 15, further comprising a control module in communication with the actuator, wherein at least one of the first and second pins is configured to move between the retracted and extended positions in response to an input from the control module.

18. The engine assembly of claim 15, wherein only one of the plurality of lobe packs includes the barrel cam.

19. The engine assembly of claim 15, wherein the control groove includes a first section and second section, each of the first and second sections includes a first groove portion, a second groove portion, and a third groove portion directly interconnecting the first and second groove portions, the third groove portion is obliquely angled relative to the longitudinal axis, the first groove portion is axially spaced apart from the second groove portion and is substantially perpendicular to the longitudinal axis, and the second groove portion is substantially parallel to the first groove portion.

20. The engine assembly of claim 19, wherein the third groove portion of the first section is obliquely angled relative to the longitudinal axis at a first oblique angle, the third groove portion of the second section is obliquely angled relative to the longitudinal axis at a second oblique angle, and the first and second oblique angles are supplementary angles.

* * * * *